United States Patent [19]

Delp

[11] 3,999,021

[45] Dec. 21, 1976

[54] THUMBWHEEL ROTARY WAFER SWITCH HAVING ODD NUMBER DETENT POSITIONS AND ROTARY WAFER PRINTED CIRCUIT PATTERN

[75] Inventor: Tony M. Delp, Richardson, Tex.

[73] Assignee: Rockwell International Corporation, El Segundo, Calif.

[22] Filed: Oct. 9, 1975

[21] Appl. No.: 621,177

[52] U.S. Cl. ..... 200/11 DA; 74/527; 200/11 TW; 200/291; 200/292

[51] Int. Cl.[2] ..... H01H 1/56; H01H 21/50; G05G 5/06

[58] Field of Search ..... 200/11 D, 11 DA, 11 G, 200/11 J, 11 TW, 275, 291, 292; 74/527

[56] References Cited

UNITED STATES PATENTS

| | | | |
|---|---|---|---|
| 2,896,033 | 7/1959 | Hartz | 200/11 DA |
| 3,030,460 | 4/1962 | Huetten et al. | 200/11 DA UX |
| 3,531,603 | 9/1970 | Ashman | 200/11 J UX |
| 3,903,383 | 9/1975 | Marker | 200/11 TW |

*Primary Examiner*—James R. Scott
*Attorney, Agent, or Firm*—Bruce C. Lutz; Robert J. Crawford

[57] ABSTRACT

A continuously rotatable electrical switch having an odd number of detent positions is used to increase the number of possible electrical circuit combinations with a given maximum number of electrical contact paths. This is accomplished by placing all the brushes on the diameter of a central rotor or rotating wafer having electrical contacts thereon wherein the contacts for both radii of the diameter for a given switch position are interleaved contacts of other switch positions. The design of the switch allows a plurality of output terminals to be continuously electrically connected to the rotor for an increased number of switching functions while maintaining the simplicity of placing all the brushes on one side of a commutating rotor.

5 Claims, 12 Drawing Figures

| DIAL POSN | RESISTORS IN CIRCUIT R1 | R2 | R3 | R6 |
|---|---|---|---|---|
| 0 | | | | |
| 1 | X | | | |
| 2 | | X | | |
| 3 | | | X | |
| 4 | X | | X | |
| 5 | | X | X | |
| 6 | | | | X |
| 7 | X | | | X |
| 8 | | X | | X |
| 9 | | | X | X |
| 10 | | | | |

| DIAL POSN | CONNECTIONS | DIAL POSN | CONNECTIONS |
|---|---|---|---|
| 0 | 1 – 5 | 6 | 1 – 4<br>9 – 10 |
| 1 | 2 – 5<br>6 – 10 | 7 | 2 – 4<br>6 – 10<br>9 – 10 |
| 2 | 1 – 3<br>3 – 5<br>7 – 10 | 8 | 1 – 2<br>3 – 4<br>7 – 10<br>9 – 10 |
| 3 | 1 – 3<br>4 – 5<br>8 – 10 | 9 | 1 – 3<br>8 – 10<br>9 – 10 |
| 4 | 2 – 3<br>4 – 5<br>6 – 10<br>8 – 10 | 10 | 1 – 5 |
| 5 | 1 – 2<br>4 – 5<br>7 – 10<br>8 – 10 | | |

THUMBWHEEL ROTARY WAFER SWITCH HAVING ODD NUMBER DETENT POSITIONS AND ROTARY WAFER PRINTED CIRCUIT PATTERN

BACKGROUND OF THE INVENTION

The present invention is generally concerned with electrical apparatus and more specifically related to electrical switches.

The prior art is replete with electrical switches of various types. However, all known prior art 360° rotation switches contain an even number of potential switch positions. The present invention utilizes an odd number so as to increase the number of possible electrical connections per position by placing all the brushes on a diameter of a commutating rotor wherein there are two brushes traveling each circular path thus interleaving the remote radii of the diameter intermediate commutating contacts of other switch positions. Although such an interleaving of the commutating contacts and practice of the present inventive concept may be accomplished by placing the brushes on two radii which are not coincident with a diameter of the commutating rotor, the expense of producing and manufacturing a set of stator brushes which provide uniform contact in this configuration for some types of switches becomes much more expensive than the present in-line design. While the word commutating has previously been used to connote mechanical retification, it is used herein to refer to the "ON - OFF" action obtained by contact or no contact between the electrical pads on the rotor and the stator brushes.

Using the present inventive concept in combination with a resistive network allows the formation of an impedance network system which with the use of one switch and four impedance networks produces integer step changes of impedance from input to output of the electrical circuit as the indicated switch position changes from 0 to 9.

OBJECTS AND DRAWINGS

It is therefore an object of the present invention to provide improved switching apparatus.

Other objects and advantages of the present invention may be ascertained from a reading of the specification and appended claims in conjunction with the drawings wherein:

DETAILED DESCRIPTION

Figure 1:
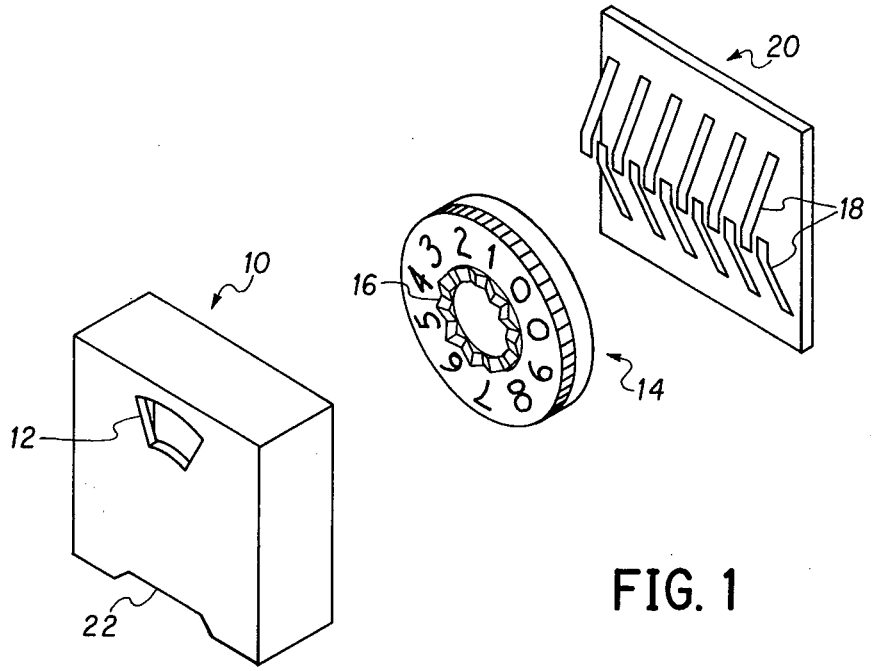
FIG. 1 is an exploded view of one embodiment of a switch utilizing the present invention.

In FIG. 1, a first portion 10 of a switch housing has an opening 12 for reading the numerical indications of a position on a rotor, drum, cylinder or rotatable mounting means 14. A set of detents 16 on mounting means 14 coact with further and cooperating detent means (not shown) within housing 10 to accurately position the drum means 14 at each of 11 possible positions. Further, the detent means 16 prevent accidental rotation due to vibration and thereby assure electrical connection of the brushes and the contacts on the commutating area. At the rear of drum 14 is mounted a printed circuit wafer, disc or commutating pattern (not illustrated in FIG. 1). This wafer has contact patterns thereon which are contacted by a plurality of brushes or contact fingers individually designated as 18 mounted on a rear housing member 20. As illustrated, there are 12 brushes 18 (six extending from each edge of 20), each providing an electrical contact between exterior terminal and commutating contacts or pads on the wafer of FIG. 2. These brushes 18 also provide a biasing force on drum 14 to eliminate vibrational rotation thereof due to the action of the detent section 16. An opening 22 in housing 10 allows operation in a rotary manner of the drum 14 to each of the indicated positions. As will be noted, the drum 14 has each of 11 positions numbered from 0 through 9 and the remaining 10th position again designated 0. In the embodiment to be discussed, each of the 0 positions provides the same electrical condition at the output.

Figure 2:
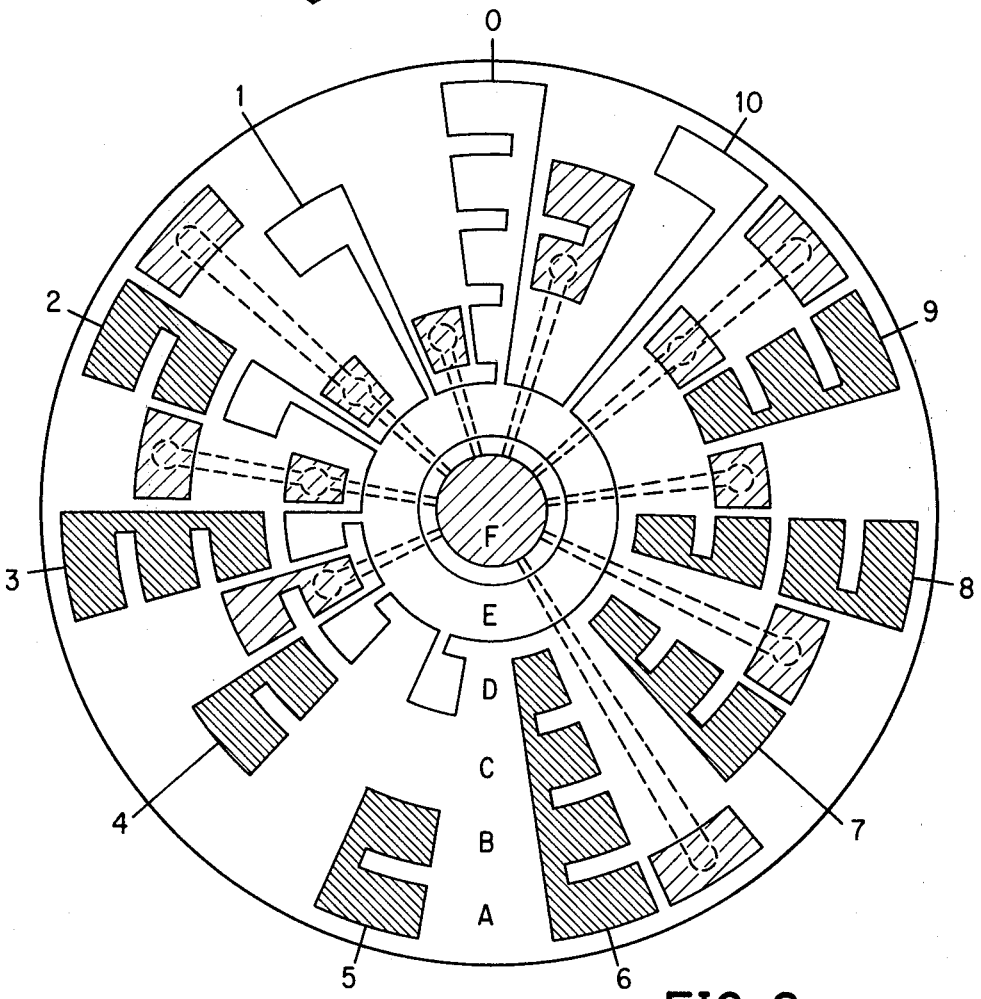
FIG. 2 is a detailed illustration of the wafer having commutating contacts thereon as used in a preferred embodiment of the invention.
Figures 3, 4, 5:
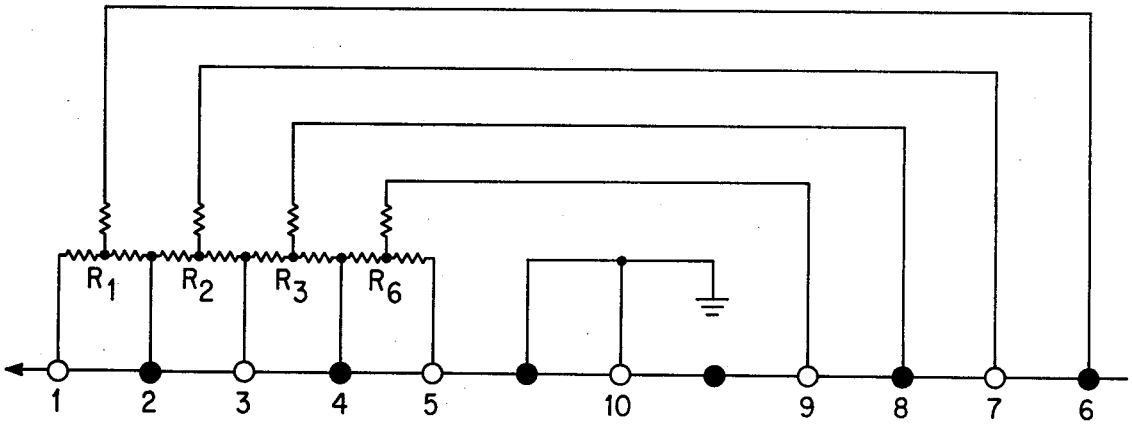
FIG. 3 shows the resistive network attached to the brushes of the switch of FIG. 1 for illustrating a specific 1236 coding application of the switch.
FIG. 4 is a chart providing an indication of which resistive networks of FIG. 3 are effectively electrically connected between terminals or brushes 1 and 5 of FIG. 3.
FIG. 5 is a further chart indicating the connection of the brushes of FIG. 3 obtained by contact with the conductive areas of FIG. 2 for each of the positions of the switch.

In FIG. 2, an illustration of a commutating pattern is provided with five rings of contacts and a solid central circular pattern illustrating six possible commutating paths. Referring back to FIG. 1, it will be noted that there are 12 brushes. However, the first brush, shown as extending from the bottom of housing 20, and the last brush, extending from the top of housing 20, ride on the same commutating path. This path is the exterior ring adjacent each of the numbered positions and is labeled A. Likewise, the two innermost brushes illustrated on housing 20, one extending from the bottom of housing 20 and the other extending from the top, provide electrical contact with the central portion F of FIG. 2. The remaining commutating paths are labeled B, C, D and E. Each of these commutating paths is electrically contacted by two brushes which are aligned in a path coincident with a diameter of the circular section of FIG. 2. As illustrated, each of the contact areas which are connected to commutating path E are not cross-hatched. All of the contact areas which are connected to commutating path F by electrical connections (shown by dash lines) on the back of the wafer are cross-hatched in a first manner. Each of the remaining contact areas which are cross-hatched in the second way are merely connected to other contact areas on the paths A through D and are not connected to the two commutating paths E and F. It may be noted that the contacts in paths E and F are each continuously electrically connected to at least one of the output terminals for the switch.

in FIG. 3, a schematic diagram is illustrated of four sets of T-pad resistive networks labeled R1, R2, R3 and R6. The input to this resistive network is connected to a point designated as 1, which is representative of the first brush on housing 20 of FIG. 1. This brush is attached to a lower portion of housing 20. Brush 2 is connected to a point between resistive networks R1 and R2 and is representative of the next brush on housing 20 as extended from the upper portion thereof. Similarly, brush 3 is the second brush extending from the lower portion of housing 20. The last brush position, which is designated as 6, is illustrative of the brush extending from the upper righthand portion of housing 20 is connected to the third resistor of the resistive network of R6. Again, when the switch is connected to the electrical network and assembled rather than exploded as shown in FIG. 1, the points labeled 1 and 6 in FIG. 3 will electrically connect appropriate portions on opposite sides of the wafer in the commutating path labeled A. As illustrated, the brushes are given designations in FIG. 3 from 1 through 10 as well as 24 and 26. Brush 24 is always electrically connected in path E to brush 5 and thus is not required for this embodiment of the invention. As further illustrated, brush 26 is always connected to brush 10 since both of these contact the central pad for the commutating area labeled as F.

As previously mentioned, the chart of FIG. 4 provides an indication of which resistive networks of FIG. 3 are operationally connected in the circuit for each of the positions of the drum 14 of FIG. 1. On the other hand, FIG. 5 illustrates the connections provided between the brushes of the switch using the numbering designation of FIG. 3 to obtain the desired results of FIG. 4. Correlating FIG. 3 with FIG. 2, it will be noted from FIG. 5 that in dial position 0, there is an electrical short from brush 1 to brush 5, thereby completely bypassing all resistive impedances of the network. Therefore, there is no resistance in position 0. As previously indicated, the resistive network R2 has twice the impedance of the resistive network R1 while resistive network R3 has three times the impedance of resistive network R1. Finally, resistive network R6 has six times the impedance of network R1.

In dial position 0, the brush 2 (a lower brush as indicated by a solid circle in FIG. 3) is connected to brush 5 (an upper brush as indicated by an open circle in FIG. 3) while lower brush 6 is connected to upper brush 10. In FIG. 2, this is illustrated as an electrical connection on the backside of the wafer from commutating path B to commutating path E. Thus, each of the resistive pads, R2, R3 and R6, are eliminated from the circuit. The third resistor of resistance network R1 is connected from commutating path A, as illustrated by the contact on the diameter on the opposite side of the wafer from position number 1, to the electrical connection on the back and hence via commutating path F to terminal 10.

A similar set of connections are provided for each of the positions 2 and 3. Thus, a skip will be made to dial position 4. In this position, the resistive networks R1 and R3 are electrically in circuit and thus brushes 2 and 3 are electrically connected together to eliminate impedance network R2. However, these electrical pads in commutating paths B and C, are not connected to either of commutating paths E or F. Brush 4 is connected to brush 5 by the electrical connection from commutating path D to commutating path E on the back of the wafer. As illustrated, it is necessary to connect the third resistors of each of the impedance networks R1 and R3 to ground. This is accomplished by the connection, on the distant radii of position 4 of the contacts illustrated in commutating paths A and C, to the commutating path F by the electrical connections on the back of the wafer.

All the remaining dial positions can be examined and, by correlation of FIGS. 2 through 5, one can ascertain the connections of the brushes 18 with the wafer of FIG. 2 to provide the desired impedance network which changes in impedance by integer steps from 0 to 9 only four impedance networks and a single 11 position, 10 electrical connection switch.

From the above, it may be noted that the eleven position switch of the present invention assures that the contact pads on the rotor for shorting out the attenuator networks R1-R6 do not make contact with the contact fingers 18 which connect to the third leg of each T-pad in any of the eleven positions. Likewise, the pads on the rotor for connecting the respective third legs to ground do not make contact with the brushes 18 used to short out the attenuator networks in any of the eleven positions. (The momentary contact incurred intermediate a position does not cause any problems.) Thus, this switch allows the brushes 18 on one-half the diameter (one radius) to be used independently from the brushes 18 on the opposite half of the diameter (or opposing radius).

Figure 7:
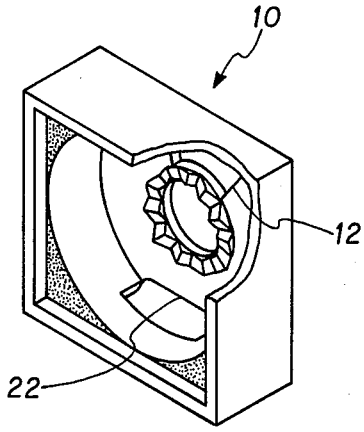

FIG. 7 illustrates a view of the opposite side of part 10 of FIG. 1. By this view it will be apparent that the back 20 can be glued or otherwise attached to the primary container portion 10. The numbers on rotor 14 will be viewable through opening 12 and the detent 16 will coact with the associated detents in FIG. 7.

Figure 8:
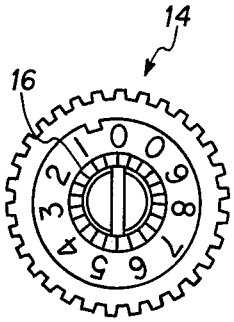
Figure 9:
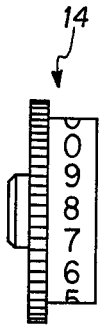
Figure 10:
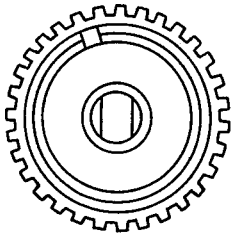

FIGS. 8, 9 and 10 illustrate front, side and back views of the wheel 14 in more detail.

Figure 11:
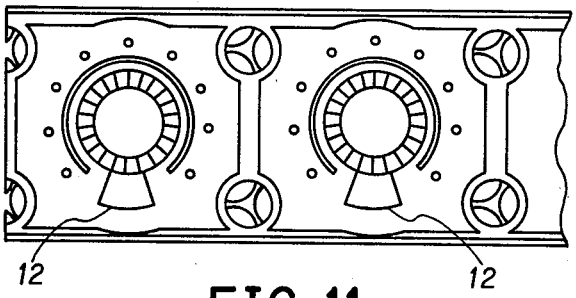
Figure 12:
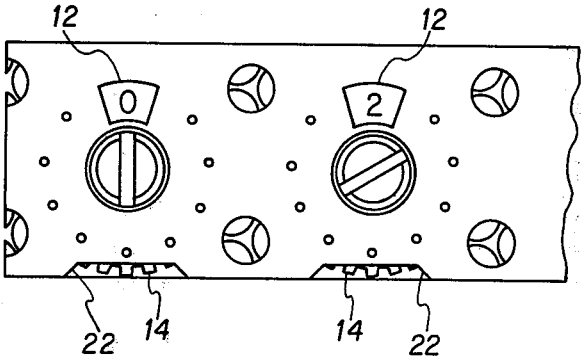

FIGS. 11 and 12 provide more detail as to a compound unit containing a plurality of the wheels 14 and provide an inside view of the container 10 and a front view incorporating the wheel 14.

Figure 6:
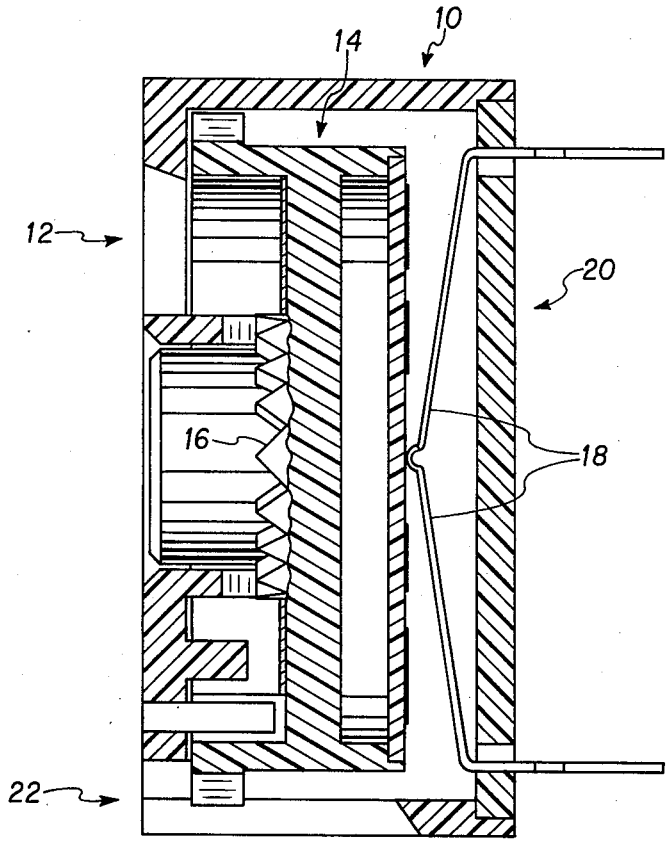
FIGS. 6, 7, 8, 9, 10, 11 and 12 illustrate in more detail the construction of the switch diagrammatically presented in FIG. 1.

FIG. 6 is a cross-sectional view of an assembled device with the contacts 18 making contact with a contact pattern such as shown in FIG. 2 as it is mounted on the back of the rotor 14. The detents 16 coact with the corresponding positions internal the structure 10 and with the spring tension provided by contacts 18 to hold a given position once turned to that position from forces provided to the edges of rotor 14 within opening 22.

While I have illustrated a particular application of my odd position switch, it will be realized by those skilled in the art that many other variations of this switch will be usable; in other words, any number of odd positions will allow the entire diameter of the switching or commutating wafer to be used for contacts to provide electrical connections with brushes. This design of a switch allows a plurality of switch terminals to be continuously connected to commutating paths within the switch while still keeping the simplicity of having all of the brushes contacting a single side of a commutating wafer. This eliminates the necessity of two opposite side sets of brushes and the rigidity and tolerance problems incurred in attempting to electrically contact two sides of a single wafer. Although the wafer shown in FIG. 2 has only two commutating paths, the outer path A may also be a continuous path with connections to other inner paths while still maintaining the two innermost continuously commutating paths. In appropriate situations, the design may be used with four or more continuously commutating paths providing alternate connections with the remaining paths. This could still be accomplished using connections on the backside of the wafer or through the use of multilayer printed circuit boards of similar procedures for interconnecting the various paths.

Further, while a specific 1 2 3 6 code was used to implement the present inventive concept for the circuit of FIG. 3, other codes such as 1 2 4 8, 1 2 3 4, etc., are equally usable.

In view of the various possible alterations of the inventive concept, I wish to be limited not to the embodiment illustrated but only by the scope of the appended claims.

What is claimed is:

1. Multiposition rotary switch apparatus comprising, in combination:

rotating wafer means, each position of the switch defining a different diameter on said wafer means;

a first set of electrically interconnected contacts located on a given surface of said wafer means on one radii of said diameter for each position of said switch apparatus;

a second set of electrically interconnected contacts located on said given surface of said wafer means on the other radii of said diameter for each position of said switch apparatus, said second set of contacts being physically positioned intermediate said first set; and first and second symmetrically located electrical output means electrically connected respectively to said first and second sets of contacts on each radii of said diameter.

2. Rotary switch apparatus of the class described comprising, in combination:

an 11 position electrical switch having contact array means wherein each of the 11 positions define an arcuate sector of approximately 32.7°;

electrical terminal means; and means for providing 10 different sets of electrical connections between said electrical terminal means.

3. Continuously rotatable switch apparatus comprising, in combination:

housing means;

electrical contact means;

output terminal means for providing electrical signals to said contact means for providing switchable passage therethrough; and detent means cooperating with said electrical contact means and said housing means for providing an odd number of switch positions, each defining a substantially identical arcuate section, in 360° of rotation.

4. Electrical switch apparatus of the class described comprising, in combination:

support means;

rotor means, including electrical contact means, positionally secured by said support means;

detent means, cooperating between said support means and said rotor means, for providing an odd number $n$ of evenly spaced positions each having an angle of $360/n°$; and stator brushes mounted on said support means for contacting said electrical contact means of said rotor means.

5. Apparatus as claimed in claim 4 wherein said electrical contact means of said rotor means includes at least two separate sets of electrical contact areas with one set residing on one radius of detent position diameters and the other set residing on opposing detect position diameters.

* * * * *